US005284118A

United States Patent [19]

Kato et al.

[11] Patent Number: 5,284,118

[45] Date of Patent: Feb. 8, 1994

[54] FUEL INJECTION CONTROL SYSTEM FOR INTERNAL COMBUSTION ENGINE

[75] Inventors: Masahiko Kato; Yasumari Okamoto, both of Hamamatsu, Japan

[73] Assignee: Yamaha Hatsudoki Kabushiki Kaisha, Iwata, Japan

[21] Appl. No.: 989,195

[22] Filed: Dec. 11, 1992

[30] Foreign Application Priority Data

Dec. 12, 1991 [JP] Japan ..... 3-351400

[51] Int. Cl.[5] ..... F02M 51/00

[52] U.S. Cl. ..... 123/478; 123/688; 123/691

[58] Field of Search ..... 123/478, 690, 691, 479, 123/688, 686, 425; 364/431.07; 60/274

[56] References Cited

U.S. PATENT DOCUMENTS

| | | | |
|---|---|---|---|
| 1,653,877 | 12/1927 | Schaff | 123/435 |
| 2,507,988 | 5/1950 | MacMillan | 123/435 |
| 2,592,284 | 4/1952 | Hopkins | 123/435 |
| 2,952,252 | 2/1959 | Geatty | 123/478 |
| 3,425,403 | 2/1969 | May | 123/478 |
| 3,698,368 | 10/1972 | Yamamoto | 123/478 |
| 3,734,072 | 5/1973 | Yamda | 123/73 A |
| 3,751,921 | 8/1973 | Blomberg et al. | 60/324 |
| 4,096,831 | 6/1978 | Gunda | 123/478 |
| 4,290,394 | 9/1981 | Frank et al. | 123/73 A |
| 4,305,351 | 12/1981 | Staerzl | 123/73 A |
| 4,327,688 | 5/1982 | Lowther | 123/435 |
| 4,351,281 | 9/1982 | Geiger et al. | 123/425 |
| 4,381,662 | 5/1983 | Jiewertz | 73/35 |
| 4,413,508 | 11/1983 | Kawamura et al. | 73/116 |
| 4,446,833 | 5/1984 | Matsushita et al. | 123/435 |
| 4,461,260 | 7/1984 | Nonaka et al. | 123/478 |
| 4,887,576 | 12/1980 | Inamoto et al. | 123/479 |
| 4,933,863 | 6/1990 | Okano et al. | 364/431.07 |
| 4,947,818 | 8/1990 | Kamohara et al. | 123/479 |
| 4,951,632 | 8/1980 | Yakuwa et al. | 123/479 |
| 5,025,767 | 6/1991 | Kume et al. | 123/691 |
| 5,168,700 | 12/1992 | Furuya | 60/274 |
| 5,168,854 | 12/1992 | Hashimoto et al. | 123/425 |
| 5,170,769 | 12/1992 | Berger et al. | 123/688 |
| 5,179,929 | 1/1993 | Miyashita et al. | 123/688 |

FOREIGN PATENT DOCUMENTS

| | | | |
|---|---|---|---|
| 47-38332 | 1/1969 | Japan | 123/478 |
| 44-8532 | 4/1969 | Japan | 123/73 R |
| 2-11862 | 6/1988 | Japan | 123/478 |
| 747534 | 4/1956 | United Kingdom | 123/478 |

*Primary Examiner*—Raymond A. Nelli
*Attorney, Agent, or Firm*—Ernest A. Beutler

[57] ABSTRACT

A fuel injection control system for a two cycle crankcase compression internal combustion engine wherein two sensors are provided for sensing air flow by measuring different engine running conditions. One sensor has a greater accuracy in a certain range of operation than the other and the system primarily sets the fuel injection based upon the output of the more sensitive sensor for the running condition. In the event of failure of the more sensitive sensor, the system defaults to control by the other sensor. The system bases the control on average readings over a number of cycles and also senses fault by determining when a sensor outputs a number of erroneous signals that are greater than a predetermined percentage.

76 Claims, 8 Drawing Sheets

*Figure 5*

| Pso / N | P1 | P2 | • | • | • | Pm |
|---|---|---|---|---|---|---|
| N1 | Q11 | Q12 | • | • | • | Q1m |
| N2 | Q21 | Q22 | • | • | • | Q2m |
| ⋮ | ⋮ | ⋮ | • | | | ⋮ |
| | | | | • | | |
| | | | | | • | |
| Nn | Qn1 | Qn2 | • | • | • | Qnm |

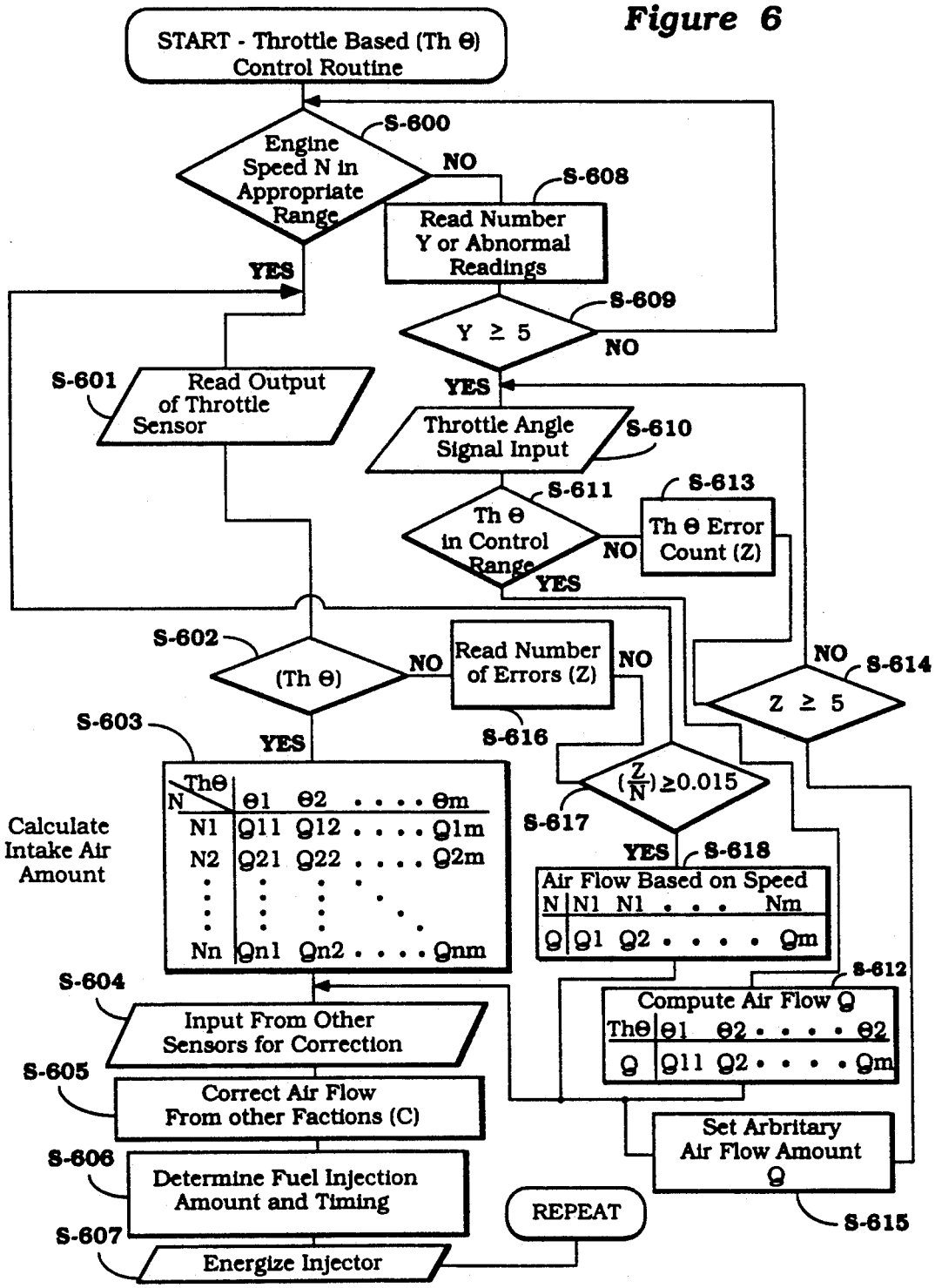
Figure 6
START - Throttle Based (Th Θ) Control Routine
S-600
Engine Speed N in Appropriate Range
NO
S-608
Read Number Y or Abnormal Readings
YES
S-609
Y ≥ 5
NO
YES
S-601
Read Output of Throttle Sensor
Throttle Angle Signal Input
S-610
S-611
Th Θ in Control Range
NO
S-613
Th Θ Error Count (Z)
YES
S-602
(Th Θ)
NO
Read Number of Errors (Z)
NO
NO
S-614
Z ≥ 5
S-603
YES
S-616
(Z/N) ≥0.015
S-617
YES
S-618
Calculate Intake Air Amount
Air Flow Based on Speed
S-612
Compute Air Flow Q
S-604
Input From Other Sensors for Correction
S-605
Correct Air Flow From other Factions (C)
S-606
Determine Fuel Injection Amount and Timing
S-607
Energize Injector
REPEAT
Set Arbitrary Air Flow Amount Q
S-615

FUEL INJECTION CONTROL SYSTEM FOR INTERNAL COMBUSTION ENGINE

BACKGROUND OF THE INVENTION

This invention relates to a fuel injection control system for an internal combustion engine and more particularly to an improved control system and routine for controlling fuel injection.

A wide variety of types of controls for fuel injection for internal combustion engines have been proposed. These controls generally sense one or more engine parameters and then set the amount of fuel injected in response to the sensed parameters. This setting is normally done by the measuring of the running conditions and then the selection of the fuel injection amount from a map generated from actual running conditions and the fuel required for each running condition. Although these systems are generally quite accurate, they do have some disadvantages.

For example, one parameter that is frequently measured is air flow to the engine. There are various types of air flow sensors which have been employed. For example, one type of air flow sensor is the so-called hot wire type that has a wire positioned across the intake opening of the engine and which is electrically heated. The temperature of the wire is indicative of air flow. In addition, various flap type valve devices have also been proposed for measuring air flow. These devices have the disadvantage of necessitating placement in the induction passage and thus reducing air flow. In addition, the characteristics of the air flow meter may change from time to time.

Another way of measuring air flow in two cycle engines consists of measuring the pressure in the crankcase chamber at different times and deriving the air flow from the pressure differences. This system can be quite accurate under many running conditions. Various other devices have been provided for measuring the air flow to an engine.

The problem with most air flow measuring systems is that they may be very accurate at a certain range of operation, however, their accuracy can be not as good as other types of devices under other running conditions. As a result, the amount of fuel supplied under the conditions when the measuring device is not as accurate will also be inaccurate.

It is, therefore, a principal object of this invention to provide an improved fuel injection control system that is capable of measuring the same condition by different methods in order to provide better accuracy throughout the entire engine running conditions.

It is a further object of this invention to provide a fuel injection control system for an engine wherein a given running parameter is sensed in two different manners and the most accurate manner is chosen to control the amount of fuel injected under the particular running condition.

It is a further object of this invention to provide an improved fuel injection control for an internal combustion engine that measures air flow to the engine in two different manners, one of which has more accuracy under certain running conditions than the other and selecting the most accurate measurement to control the fuel for a given running condition.

As has been noted, various devices have been proposed for measuring engine conditions to control the amount of fuel injected to an engine. Frequently systems incorporate malfunction sensors which determine when a sensor is giving a false signal and the system then goes to a failure mode. Generally these failure modes provide a fixed amount of fuel regardless of the actual running condition when the sensor fails. Obviously this type of system has a number of disadvantages.

It is, therefore, a still further object of this invention to provide an improved fuel injection system that has two sensors for sensing a given running condition and wherein the control is shifted from one sensor to the other in the event the one sensor is determined to have failed.

As previously noted, it is desirable to include some form of system for determining a failure of a sensor in a fuel injection control so as to provide compensation in the event of sensor failure. One way that sensor failures are determined is if the sensor outputs a signal that is clearly indicative of an abnormal condition. It is, obviously, desirable to ensure against inadvertent shifting into the failure mode in the event the sensor has not actually failed. As a result, the abnormal condition which indicates a failure is normally chosen as one which is far outside of the range of normal conditions. This will insure against false failure signals. However, it will also provide a situation wherein the sensor has failed but not so severely as to indicate a failure mode and inadequate fuel control will result.

If the tolerance of acceptable values from the sensor is set too low, however, then a failure mode may be indicated when failure has not actually occurred. That is, even an engine running under normal conditions can produce some variations in running condition signals without there necessarily being a failure in the sensor.

It is, therefore, a still further object of this invention to provide an improved method for detecting a sensor failure in a fuel injection system.

It is a further object of this invention to provide a method of sensing failure of a sensor in a fuel injection system that indicates a failure mode when the sensor deviates from a normal output for a certain percentage of its output signals.

As just discussed, the engine conditions can vary significantly from one cycle to the next even though the basic running condition of the engine is unchanged. That is, even during normal running of the engine there will be some variations from cycle to cycle. Hence, if the sensor senses the operation or condition at only a single cycle and this determines the amount of fuel supplied, there can be errors in the amount of fuel supplied to the engine.

It is, therefore, a still further object of this invention to provide an improved condition sensing arrangement for a fuel injection control.

It is a further object of this invention to provide an engine sensing condition for a fuel injection control wherein the sensed conditions are measured over a number of cycles and the control is based upon the average of the sensed conditions. This information is then updated on each cycle.

SUMMARY OF THE INVENTION

First features of the invention are adapted to be embodied in a fuel injection control system and method for an internal combustion engine that has a fuel injector for injecting fuel for engine operation. First sensor means are provided for sensing a first running condition and second sensor means are provided for sensing a second running condition different from the first running condition. Control means receive signals from the first sensor means and from the second sensor means and control the fuel injected by the fuel injector.

In accordance with a first feature of the invention, the control means includes means for determining which of the signals from the first and second sensor means will determine the primary control of the fuel injected by the fuel injector and that control signal is applied.

In accordance with a method of practicing this invention, the signals from the first and second sensor means are checked and it is determined from the signals which will be used to provide the primary control of the fuel injected by the fuel injector.

Another feature of the invention is embodied in a fault detecting system and method for an internal combustion engine fuel injection control system. The control system comprises means for detecting an engine running condition and outputting a signal indicative of the condition for processing by the fuel control system.

In accordance with a system for practicing this facet of the invention, the fault detecting system is comprised of means for comparing the signal outputted from the means for detecting the engine running condition and comparing that signal with a normally expected signal for the engine running condition. If there is a deviation, an error signal is generated and repeated comparisons are made for a predetermined number of times. If the percentage of error signals during the predetermined number of measurements exceeds a certain percentage, a failure mode is determined.

In accordance with a method of practicing this facet of the invention, the signals outputted from the means for detecting the engine running condition are compared with normally expected signals for the engine running condition. If there is a deviation, an error signal is generated and successive measurements are made. If the percentage of errors for a given number of measurements exceeds a predetermined value, an error condition is determined.

Still further features of the invention are adapted to be embodied in a fuel injection control system and method for an internal combustion engine that comprises means for sensing an engine running condition and providing an output signal indicative of that condition.

In accordance with the system of practicing this invention, means are provided for accumulating a set number of signals from successive number of measurements and the control signal for the fuel injector is generated from the accumulated value of the signals.

In accordance with a method for practicing this invention, the output signals are accumulated for a certain number of measurements and the accumulated value is employed for controlling the amount of fuel injected.

BRIEF DESCRIPTION OF THE DRAWINGS

FIG. 5 is a graphical view showing how the fuel injection amount is determined by crankcase pressure.

FIG. 6 is a graphical view showing a subcontrol routine employed in the routine of FIG. 3 when air flow is measured by throttle position and engine speed.

DETAILED DESCRIPTION OF THE PREFERRED EMBODIMENTS OF THE INVENTION

Figure 1:
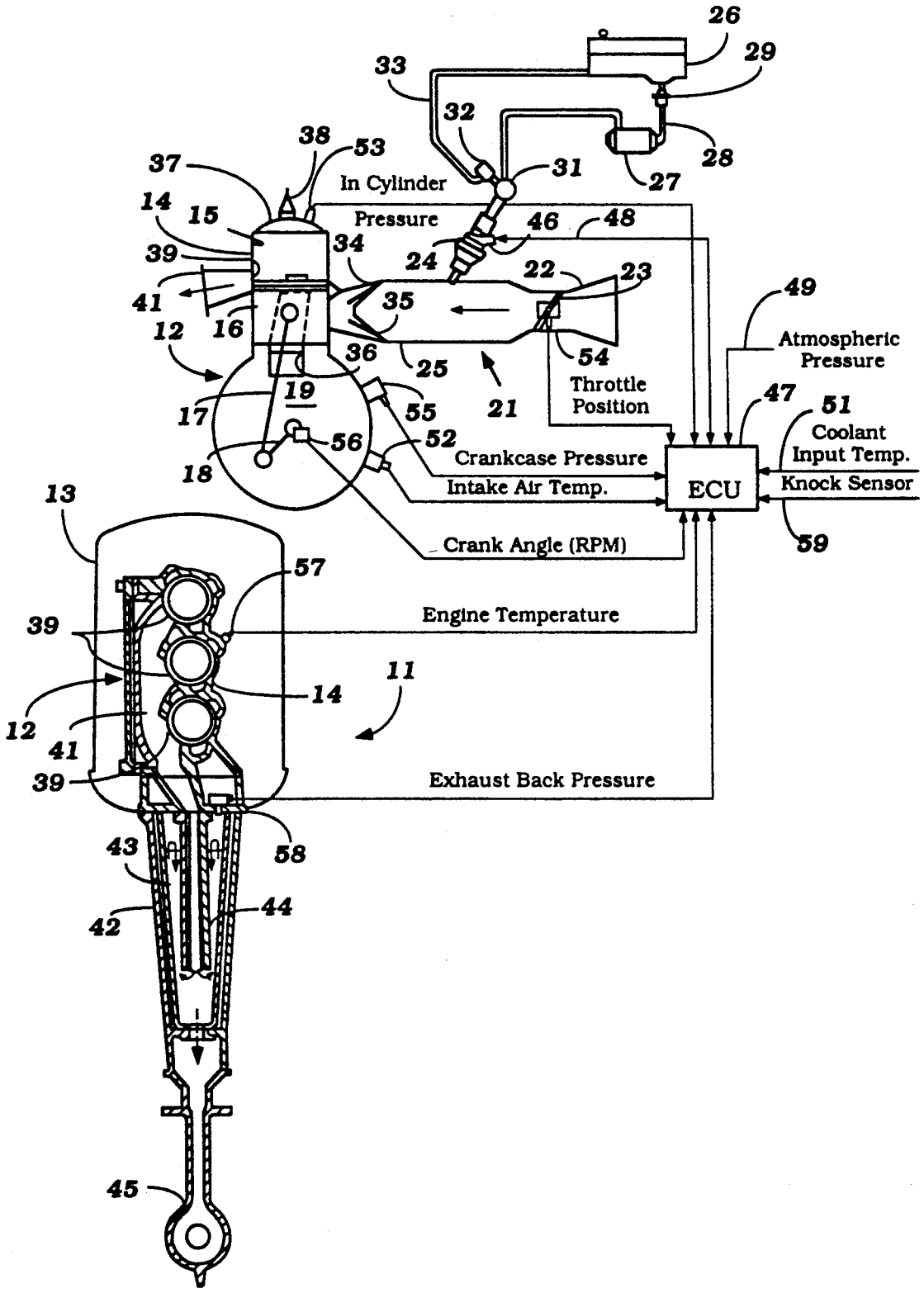
FIG. 1 is a partially schematic view of an outboard motor incorporating an internal combustion engine having a fuel injection control system constructed and operated in accordance with the invention.

Referring now in detail to the drawings and initially to FIG. 1, an outboard motor is shown partially in cross section and with portions shown in phantom and is identified generally by the reference numeral 11. This view is composite view and a single cylinder of the powering internal combustion engine is shown in cross section with the engine being identified generally by the reference numeral 12 and the associated fuel injection system for it shown partially in cross section and partially schematically. The invention is described in conjunction with an outboard motor only as a typical environment in which the invention may be practiced. The invention has particular utility with two cycle crankcase compression internal combustion engines and since such engines are frequently employed as the power plants for outboard motors, an outboard motor is a typical environment in which the invention may be employed.

The outboard motor 11, as already noted, includes a powering internal combustion engine 12 which, in the illustrated embodiment, is comprised of a three cylinder in-line engine. It will be readily apparent to those skilled in the art how the invention can be employed in conjunction with engines of other configurations.

The engine 12 forms a portion of the power head of the outboard motor and this power head is completed by a protective cowling 13 which surrounds the engine 12 in a known manner. As may be seen in the upper view of this figure, the engine 12 is comprised of a cylinder block 14 in which three aligned cylinder bores 15 are formed. Pistons 16 reciprocate in the cylinder bores 15 and are connected to connecting rods 17 which, in turn, drive a crankshaft 18 in a well known manner. The crankshaft 18 is rotatably journaled within a crankcase assembly which is divided into individual chambers 19 each associated with a respective one of the cylinder bores 15 and which are sealed from each other in a manner well known in this art.

A fuel/air charge is delivered to the crankcase chambers 19 by an induction system, indicated generally by the reference numeral 21, and which includes an atmospheric air inlet 22 in which a manually operated throttle valve 23 is positioned. An electronically operated fuel injector 24 sprays fuel into an intake manifold 25 downstream of the throttle valve 23. The fuel injector 24 receives fuel from a fuel system including a remotely positioned fuel tank 26. Fuel is drawn from the fuel tank 26 by means of a high pressure fuel pump 27, through a conduit 28 in which a filter 29 is positioned. This fuel then delivered to a fuel rail 31 in which a pressure regulator 32 is provided. The pressure regulator 32 maintains the desired pressure in the fuel rail by bypassing excess fuel back to the fuel tank 26 through a return conduit 33. The operation of the fuel injector 24 will be described in more detail later.

The intake manifold 25 delivers air to the intake ports 34 of the engine through reed type check valves 35 which operate to preclude reverse flow. The inducted charge is drawn into the crankcase chambers 19 upon upward movement of the pistons 16 and then is compressed upon downward movement. The compressed charge is then transferred to the area above the pistons 16 through a plurality of scavenge passages 36 in a manner well known in this art.

A cylinder head 37 is affixed to the cylinder block 14 in a known manner and defines a recess which forms part of the combustion chamber. A spark plug 38 is mounted in each cylinder recess and is fired by the ignition system in a known manner.

The cylinder block 14 is formed with an exhaust port 39 for each cylinder which communicates with an exhaust manifold 41 formed in part in the cylinder block 14.

As is typical with outboard motor practice, the cylinder block 14 and cylinder head 37 are formed with cooling jackets through which coolant is circulated from the body of water in which the outboard motor 11 is operating in any conventional manner.

A driveshaft housing 42 depends from the power head and rotatably journals a driveshaft which is driven by the engine crankshaft 18 in a known manner. The driveshaft housing 42 is formed with an internal expansion chamber 43 to which exhaust gases are delivered from the exhaust manifold 41 by an exhaust pipe 44. Any suitable internal baffling and cooling system is provided for the exhaust gases and they are then discharged through a conventional underwater high speed exhaust gas discharge, which may comprise an outlet formed in the lower unit 45 or in the hub of a propeller driven by the driveshaft. In addition, an above the water, low speed gas discharge may be incorporated.

The construction of the outboard motor 11 and its powering internal combustion engine 12 as thus far described may be considered to be conventional and all of the components which have been illustrated may be of any conventional type. Since the invention deals with the fuel injection system for the engine and its control, it is believed unnecessary to describe in further detail the components of the engine which may be considered to be conventional.

Referring now in more detail to the fuel injection system and the control therefor, as previously noted, the fuel injector 24 is electronically controlled. To this end, it is provided with an electrical terminal 46 that receives an output control signal from an ECU, indicated generally by the reference numeral 47, through a conductor indicated by the line 48. A solenoid of the fuel injector 24 is energized when the ECU 47 outputs a signal to the terminal 46 through the line 48 to open an injection valve and initiate injection. Once this signal is terminated, injection will also be terminated. The injector 24 may be of any known type and in addition to a pure fuel injector may comprise an air/fuel injector.

A number of ambient atmospheric conditions are supplied to the ECU and certain engine running conditions are supplied to the ECU 47 so as to determine the amount of fuel injected and the timing of the fuel injection. These ambient conditions may comprise atmospheric pressure which is measured in any suitable manner by a sensor and which signal is transmitted to the ECU 47 through a conductor 49, temperature of the cooling water which is delivered to the engine cooling jacket from the body of water in which the watercraft is operating as sensed by an appropriate sensor (not shown) and transmitted through to the ECU 47 through a conductor 51, and the intake air temperature as sensed in the crankcase chamber 19 by a temperature sensor 52 which outputs its signal to the ECU 47 through a conductor. Additional ambient conditions may be measured and employed so as to provide more accurate control of the fuel injection, if desired.

There are also provided a number of engine condition sensors which sense the following engine conditions. An in-cylinder pressure sensor 53 senses the pressure within the cylinder and outputs this signal to the ECU 47 through an appropriate conductor. A throttle valve position sensor 54 senses the position of the throttle valve and outputs this signal to the ECU 47. Crankcase pressure is sensed by a pressure sensor 55 which is also mounted in the crankcase chamber 19 and outputs its signal to the ECU 47. Crank angle position indicative of the angular position and rotating speed of the crankshaft 18 is determined by a sensor 56 and outputted to the ECU 47. Engine temperature is sensed by a sensor 57 mounted in the cylinder block 14 and inputted to the ECU 47. Exhaust system back pressure in the expansion chamber 43 is sensed by a sensor 58 and is outputted to the ECU 47. Finally, a knock sensor (not shown) outputs a signal to the ECU 47 when a knocking condition is sensed through the conductor 59. As with the ambient conditions, additional engine running conditions may be sensed. Those skilled in the art can readily determine how such other ambient or running conditions can be sensed and fed to the ECU 47 and processed by the ECU 47 to determine the fuel injection supply both in timing and amount.

The important feature of the invention resides in the fact air flow to the engine is measured by two different engine conditions. The first condition is throttle position and speed and the second condition is crankcase pressure. As noted before, the throttle position and speed are measured by the throttle position sensor 54 and crank angle sensor 56. The other way in which induction air flow is sensed is by measuring the crankcase pressure by the crankcase pressure sensor 55 in accordance with a method as described in U.S. Pat. No. 4,461,260, entitled "Fuel Injection System for Two-Cycle Internal Combustion Engines" and issued Jul. 24, 1984.

The crankcase pressure sensing method is extremely effective in determining the air flow to the engine in a simple manner and one which does not inhibit air flow into the induction system. Although this method of measuring is extremely accurate, its accuracy is not as good during transitional running conditions as with steady state running conditions. Therefore, the crankcase pressure sensing is used for determining fuel injection amounts under conditions when the engine is operating in a steady state condition while the throttle position/engine speed sensing is used for controlling the amount and timing of fuel injection during transitional conditions (acceleration or deceleration). The way in which this is done will be described later.

Figure 2:
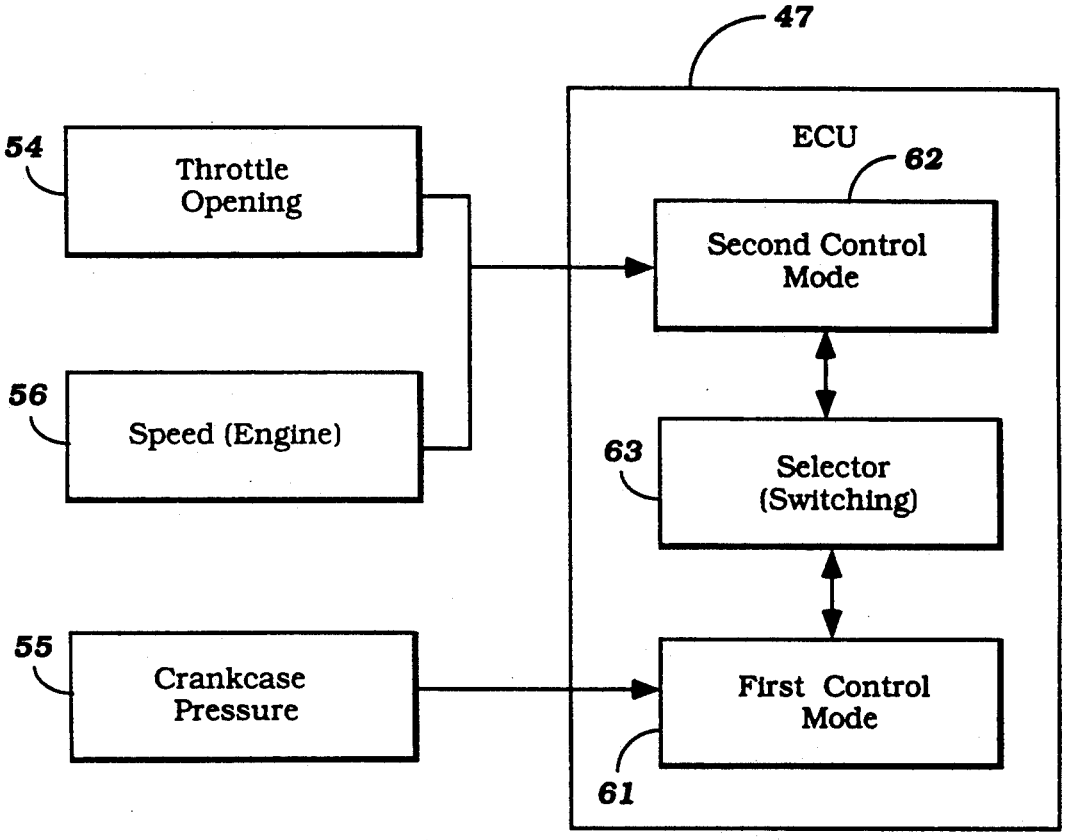
FIG. 2 is a block diagram showing the elements of the fuel injection control.

FIG. 2 is a block diagram showing how these different control parameters are employed. Referring to this figure, it will be noted that ECU 47 includes a section which is indicated generally reference numeral 61, as the first control mode which is responsive only to the crankcase pressure signal from the sensor 55. There is provided a second control mode 62 which determines air flow from throttle opening and engine speed as measured by the sensors 54 and 56 respectively. The ECU further includes a switching unit 63 which takes the outputs from the mode systems 61 and 62 and determines which of them will be employed for controlling the amount of fuel injection and timing of fuel injection. This control routine will now be described by initial reference to FIG. 3.

Figure 3:
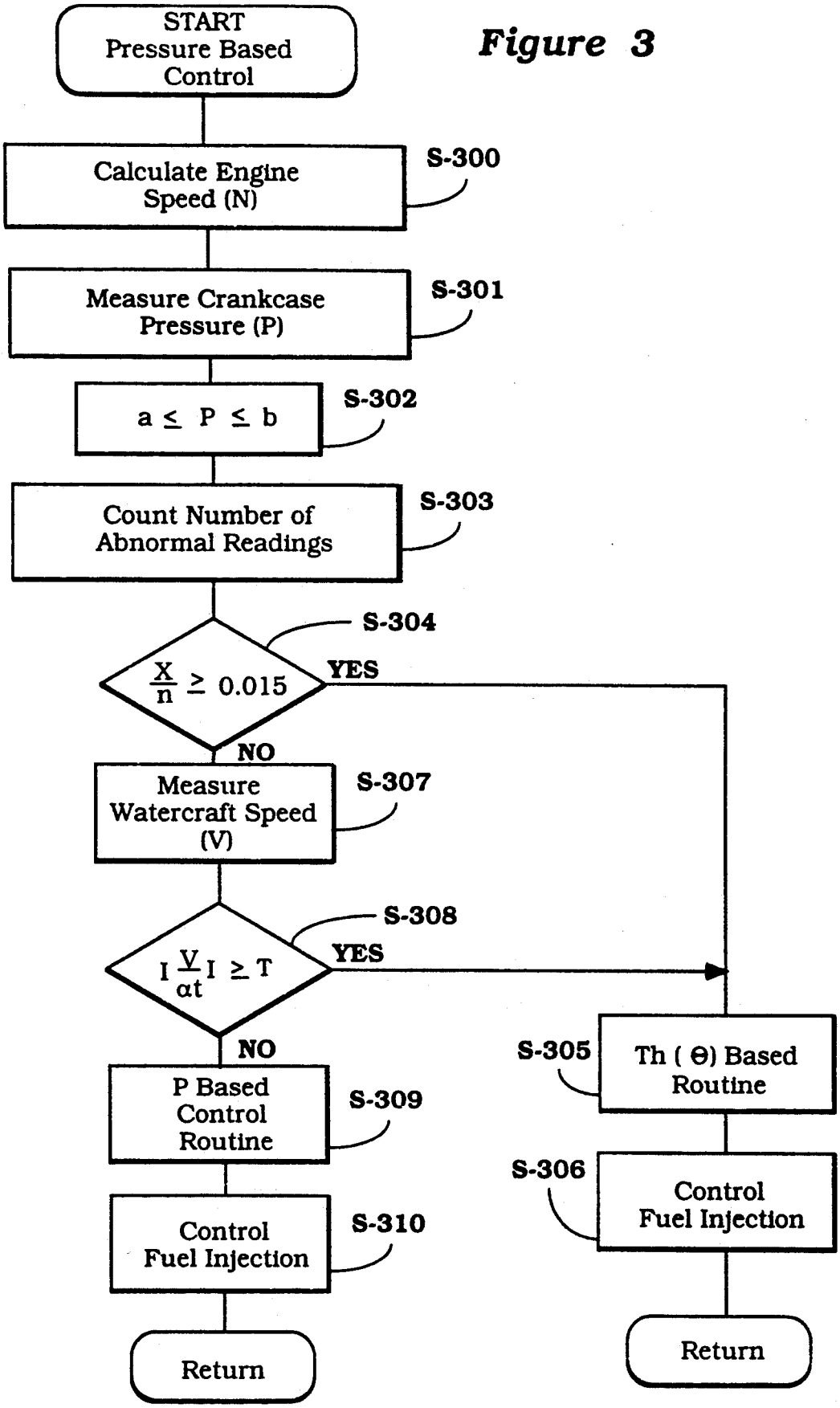
FIG. 3 is graphical block diagram showing the overall control routine for the fuel injection control.

Before describing in detail the routine of FIG. 3, a brief explanation of the control mode determination system is believed to be in order. Basically the system operates to initially control fuel injection amount and timing in response to air flow as measured by the variations in crankcase pressure in accordance with that method set forth in aforenoted U.S. Pat. No. 4,461,260. This measures pressure just before scavenge port opening and near the point of scavenge port closure and determines air flow from the pressure difference. If, however, it is determined that the outputs from the pressure sensor are abnormal, then the program defaults to a routine wherein air flow is measured by throttle angle position and engine speed in accordance with mode 62 of FIG. 2. If the pressure sensor is determined to be operating in a normal and not an abnormal mode, it is also determined if the engine is being accelerated or decelerated. As noted above, the crankcase pressure signals are not as accurate in measuring air flow during these transitional modes. If the engine is operating in a non accelerating or decelerating condition, the control routine based upon pressure in the crankcase chamber is maintained. If, however, the engine is determined to be in a transitional stage, then fuel injection control based upon air flow determined by throttle position and engine speed is employed.

With this background in mind, FIG. 3 will now be described. Once the program starts, it moves to the step S-300 so as to calculate engine speed (N). Engine speed is calculated by using the output of the crank angle sensor 56 in relation to time to measure the engine rotational speed. The program then moves to the step S-301 to measure the crankcase pressure by means of the crankcase pressure sensor 55. This crankcase pressure measurement is made at a particular crank angle at each time and to add a correcting factor in as the pressure detection can vary in response to engine speed. The program then moves to the step S-302 to determine if the detected crankcase pressure (P) lies within the range of normally anticipated pressures at the given crank angle with the lower limit being "a" and the upper limit being "b". If the crankcase pressure as thus measured is within this range ($a \leqq P \leqq b$) it is determined that the crankcase pressure is normal and the crankcase pressure sensor 55 is providing accurate readings. If, however, at the step S-302 an individual reading of the crankcase pressure is outside of the range a-b, then a count is added to a counter at the step S-303 so as to count the number (X) of abnormal readings of pressure.

In accordance with an important feature of the invention, the mere sensing of one abnormal pressure reading does not constitute a determination that the pressure sensor 55 is malfunctioning. Rather, there must be a certain abnormal number of readings in a given period of time. This determination is made at the step S-304 wherein the percent of abnormal readings is determined by measuring the number of abnormal readings X to the total of reading taken n. If the percentage error is not greater than one and one-half percent (1½%), the program is determined to be operating in a normal mode.

If, however, at the step S-304 it is determined that the number of abnormal readings is excessive, the program moves to a condition so as to set the fuel injection at the step S-305 on the throttle valve and engine speed control mode (62 of ECU 47). The method by which this is done will be described later, but for the purposes of illustration the control for fuel injection in accordance with the throttle valve based routine is shown at the step S-306 wherein fuel injection control is initiated in accordance with this routine and then the program returns to start.

If it has been determined at the step S-304 that the crankcase pressure sensor 55 is acting normally, the program moves to a series of steps to determine if the engine is operating in steady state or transient conditions. One way this can be done, and an extremely accurate way, is to proceed to the step S-307 and actually measure velocity (V) of the watercraft. Another way in which transient conditions are sensed will be described later. The program then moves to the step S-308 ($V/\alpha t$) to determine the change in velocity with respect to time and determine if this is greater than or equal to a value T which would indicate rapid acceleration or deceleration.

If at the step S-308 it is determined that there is rapid acceleration or deceleration then it is determined that control should not be based upon crankcase pressure (P) and the program moves again to the step S-305 so as to determine air flow and fuel injection amount based upon throttle valve and engine speed.

If, however, at the step S-308 it is determined that the engine is not in a transient condition, the program moves to the step S-309 so as to control the fuel injection on the pressure (P) based control routine. This control routine will be described shortly by reference to FIG. 4. Once the (P) based control routine is determined at the step S-309, the program moves to the step S-310 so as to control fuel injection upon this routine and then return to start.

The subroutine accomplished at the steps S-309 and S-310 of FIG. 3 will now be described by reference to FIG. 4. Again, the program rechecks to determine if the engine is operating in a steady state condition and again affirms that the pressure sensor is outputting appropriate signals. In this control routine the steady state condition is, by way of example, described in conjunction with rate of change of throttle valve position. It is to be understood, however, that boat velocity changes may also be employed in this control routine as with the control routine applied at the step S-308 in FIG. 3. Alternatively, the control routine for detecting throttle angle conditions now to be described may be employed in the step S-308 of FIG. 3 to determine transient conditions.

At the step S-400 after start, the opening condition of the throttle valve 23 is determined by measuring the throttle valve position by the sensor 54. The program then moves to the step S-401 to determine the rate of change of the position of the throttle valve ($dTh\Theta/dt > \alpha$). If the value is greater than $\alpha$, then the program determines that the acceleration is such that fuel injection amounts should not be determined by crankcase pressure and the program skips the succeeding steps now to be described to move to a control routine based upon throttle angle position.

Assuming, however, at the step S-401 is has been determined that the engine is not operating in a transient condition, the program moves to the step S-402 to determine the crank angle at which the scavenge port begins to open for a measuring of the crank angle at this point. This is corrected in accordance with the procedure set forth at the step S-301 in response to variations in measured pressure in response to speed. The program then moves to the step S-403 to actually detect crankcase pressure ($PS_O$) at the time when the scavenge port begins to open. Once the crankcase pressure ($PS_O$) is measured, the program moves to the step S-404 to determine abnormality in measurements in accordance with a method similar to that set forth in steps S-303 and S-304. This judgment is made at the step S-405 and if the abnormal condition is sensed, the program moves to the control based upon throttle opening and engine speed, which will be described.

If, however, at the step S-405 it is determined that the crankcase pressure measurements are accurate, the program moves to the step S-406 to actually calculate intake air amount based upon $PS_O$ and engine speed (N). This is done by referring to a map programmed internally in the ECU 47 and as shown in FIG. 5 wherein the various quantities of air (Q) inducted are based upon engine speeds (N) and crankcase pressure at the time of opening of the scavenge port ($PS_O$). This map is generated on actual measurements made from an engine under these varying conditions. This map is then preprogrammed into a memory of the computer. Once the amount of air (Q) is determined at the step S-406, the program moves to the step S-407 to calculate the amount of fuel required to generate the desired fuel/air ratio based upon the air amount calculated at step S-406. The program then moves to the step S-408 to calculate any adjustments that should be made in the injector time based upon various other sensed parameters. The program then moves to the step S-409 to energize the injector to supply the desired fuel amount and injection timing. The program then returns.

As has been noted, if the judgment at the step S-401 indicates that there is a transient condition or if at the step S-405 it has been determined that the pressure sensor 55 is acting abnormally, the program moves to the step S-410 to calculate air amount based upon throttle valve position and engine speed. The control routine by which this is done either at the step S-410 or at the step S-305 in the main routine of FIG. 3 will now be described by reference to FIG. 6.

Once the throttle position based air sensing program starts, it moves to the step S-600 to measure engine speed (N) and determine whether the engine speed is in an appropriate speed range for throttle based control and also to establish the engine speed. This is determined in accordance with a method similar to that of determining the appropriate range of crankcase pressures as set forth in steps S-301 and S-302 of FIG. 3. If the engine speed is determined at the step S-600 to be in the appropriate range, the program moves to the step S-601 so as to read the output of the throttle angle position sensor 54 and the program then moves to the step S-602 so as to determine the actual throttle valve position (ThΘ). At this step it is determined if the throttle valve position is within the range where calculation of intake air amount from throttle valve position is possible. This again is done in accordance with steps similar to S-301 and S-302 of FIG. 3.

Figure 7:
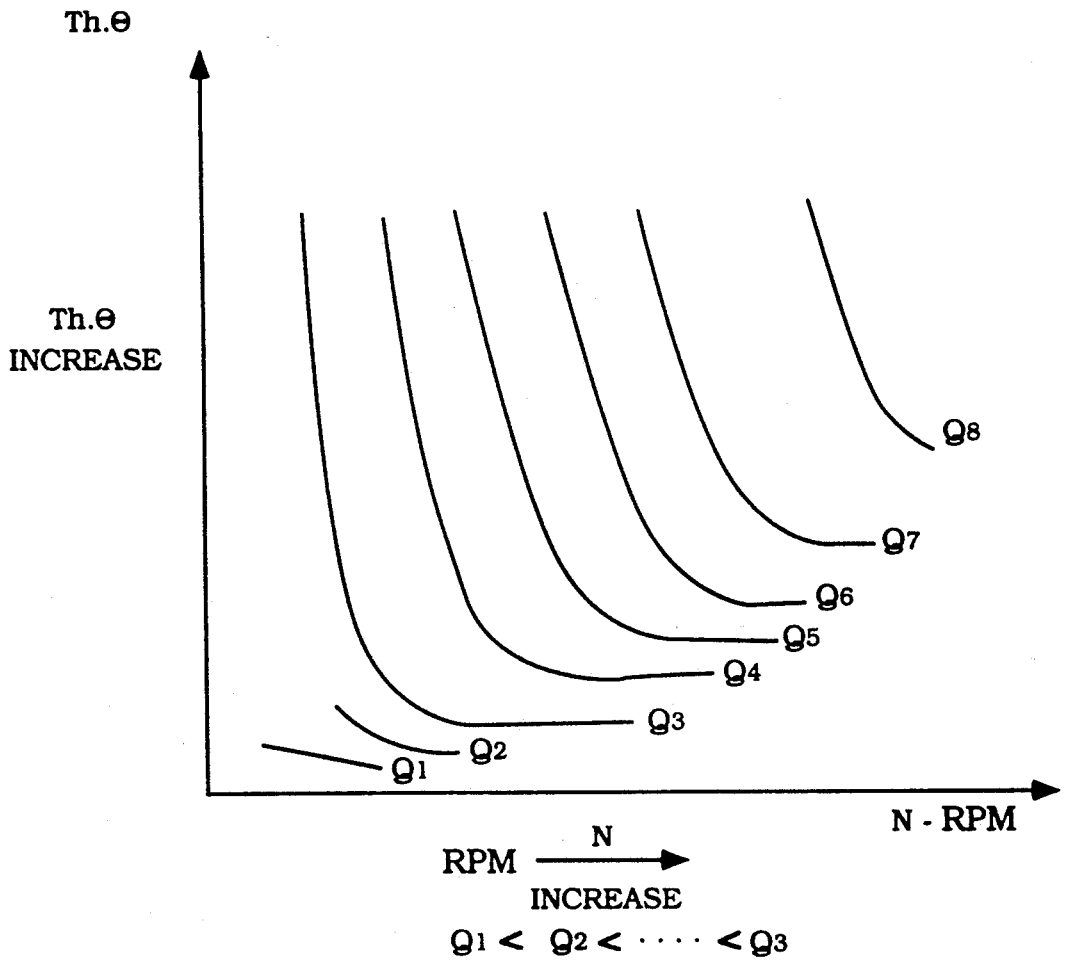
FIG. 7 is a graphical view showing the maps by which fuel injection amount is determined in response to throttle position and engine speed.

If at the step S-602 it is determined that the throttle position is in the desired range, the program moves to the step S-603 to calculate the intake air amount (Q) from a preprogrammed map which appears in this figure at the step S-603. This map is preprogrammed into a memory of the ECU 47 and indicates intake air amount in relation to engine speed (N) and throttle valve position (ThΘ). This map is also depicted in FIG. 7 wherein intake air amounts (Q) are indicated in response to various throttle valve positions (ThΘ) and engine speeds (N). Rather than use the readings for single cycle, however, readings are taken for four successive cycles and then averaged. Subsequent readings then are added and the earliest readings discarded so that the intake air amount will not be calculated on only a single engine cycle but on four engine cycles. This will provide much more accurate control because, even though an engine operates at a fairly constant speed, there can be significant cycle to cycle variations and by averaging a number of steps, these variations, which could adversely affect overall control, can be avoided.

The program then moves to the step S-604 so as to receive the inputs from other sensors which might indicate the need for correction in the amount of intake air read from the chart of steps S-603 in FIG. 7. That is, if ambient air temperature varies or pressure varies, the amount of air flow can require correction and the appropriate correction step is made at the step S-605 wherein is a corrective factor (C). The program then moves to the step S-606 so as to determine the fuel injection energization initiation and duration. The program then moves to the step S-607 so as to energize the injector 24 for the appropriate time interval and the program then repeats.

The operation and control under abnormal conditions will now be described again continuing to refer to FIG. 6. As has been noted, at the step S-600 it is determined whether or not the engine speed N is in the appropriate range. If the engine speed is not in the appropriate range, the program moves to a step S-608 so as to record the number of times (Y) when the engine speed is read outside of that range. The program then moves to the steps S-609 to determine if the number of abnormal readings (Y) is equal to or exceeds five. If it does not, the program then returns back to the step S-600 and continues to operate in a normal mode.

The number 5 is decided experimentally to attempt to discriminate between mere electrical noise and actual sensor abnormality. If there are five abnormal speed readings, then the program must default and if that happens, the program then moves to the step S-610 to begin a program of control routines based only upon throttle angle position since it is determined that the engine speed signal cannot be relied upon for establishing air flow amount. This can occur either due to a failure of the crank angle sensor 56 or operation outside of the desired speed range.

After the throttle angle signal input is taken at the step S-610, the program moves to the step S-611 so as to measure the actual throttle angle (ThΘ) and determine if it is in the suitable control range. This procedure is similar to the procedure followed in the steps S-301 and S-302 of FIG. 3 wherein the throttle angle is measured relative to a maximum and minimum throttle angle.

If the throttle angle is not at the appropriate value in the step S-611, the program moves to step S-612 to count the number of errors (Z) in the throttle position. If the number of errors in throttle position does not exceed five, the program repeats back to the step S-610. Again, the number five is chosen to discriminate between electrical noise and sensor failure readings and if the errors do not equal five, then the program is assumed to be satisfactory. If, however, at the step S-614 it is determined that the number of incorrect throttle signals have been exceeded, the program then moves to a default safety mode at step S-615 so as to pick an arbitrary setting for air flow. The program then takes this arbitrary flow value (Q) and proceeds to the steps S-604, S-605, S-606 and S-607 so as to initiate fuel injection based upon this value.

If at the step S-611 it has been determined that the throttle valve position (ThΘ) is within the control range, the program then moves to the step S-612 so as to compute air flow based solely upon throttle valve position. This can be done by calculating a basic air intake amount solely by throttle valve position and preprogramming this map, shown in step S-605 into the ECU 47. Once the air flow amount (Q) is determined at the step S-612, the step moves to the steps S-604, S-605, S-606 and S-607 to set fuel injection based upon this determination and in the manner previously described.

If at the step S-602 it has been determined that the position of the throttle valve (ThΘ) is not within the control range, the program moves to the step S-616 so as to count the number of errors (Z). The percentage of errors per engine speed (N) from the reading at step S-600 is then calculated at the step S-617. Engine speed is used here because the higher the engine speed the less sensitive the engine is. Again, if the number of errors is less than one and one-half percent (1½%) of engine speed, it is assumed that the variations do not indicate an abnormal position of throttle valve setting and the program repeats back to the step S-602.

If, however, at the summing step S-617 it is determined that the percentage error is greater than that desired, then the program moves to a default mode S-618 so as to again set an arbitrary air flow based upon engine rotating speed N alone in accordance with a preprogrammed map as indicated at the step S-618.

In the embodiments of the invention as thus far described, it should be readily apparent that the control routine is such that the fuel injection is controlled based upon parameters which are most indicative of actual engine requirements. Also, in the event of error signals there are default modes that are employed that will ensure that relatively accurate fuel control will be supplied regardless of defects in the certain sensors. There is another state which is not accommodated specifically by the embodiment thus far described and that has to do with the condition wherein the engine is operating with very low throttle openings. This control routine is accomplished when the fuel injection control is based primarily on throttle valve position due to the existence of transitional stages in engine operation. However, when the throttle valve opening is relatively small, slight variations in throttle valve position can change significantly the amount of air flow. Therefore, this control routine operates to provide air flow measurement under small throttle openings, even under transient conditions, based upon the crankcase pressure based routine of air flow measurement. However, when the throttle opening is not small, then the throttle valve position is employed to determine air flow.

Figure 8:
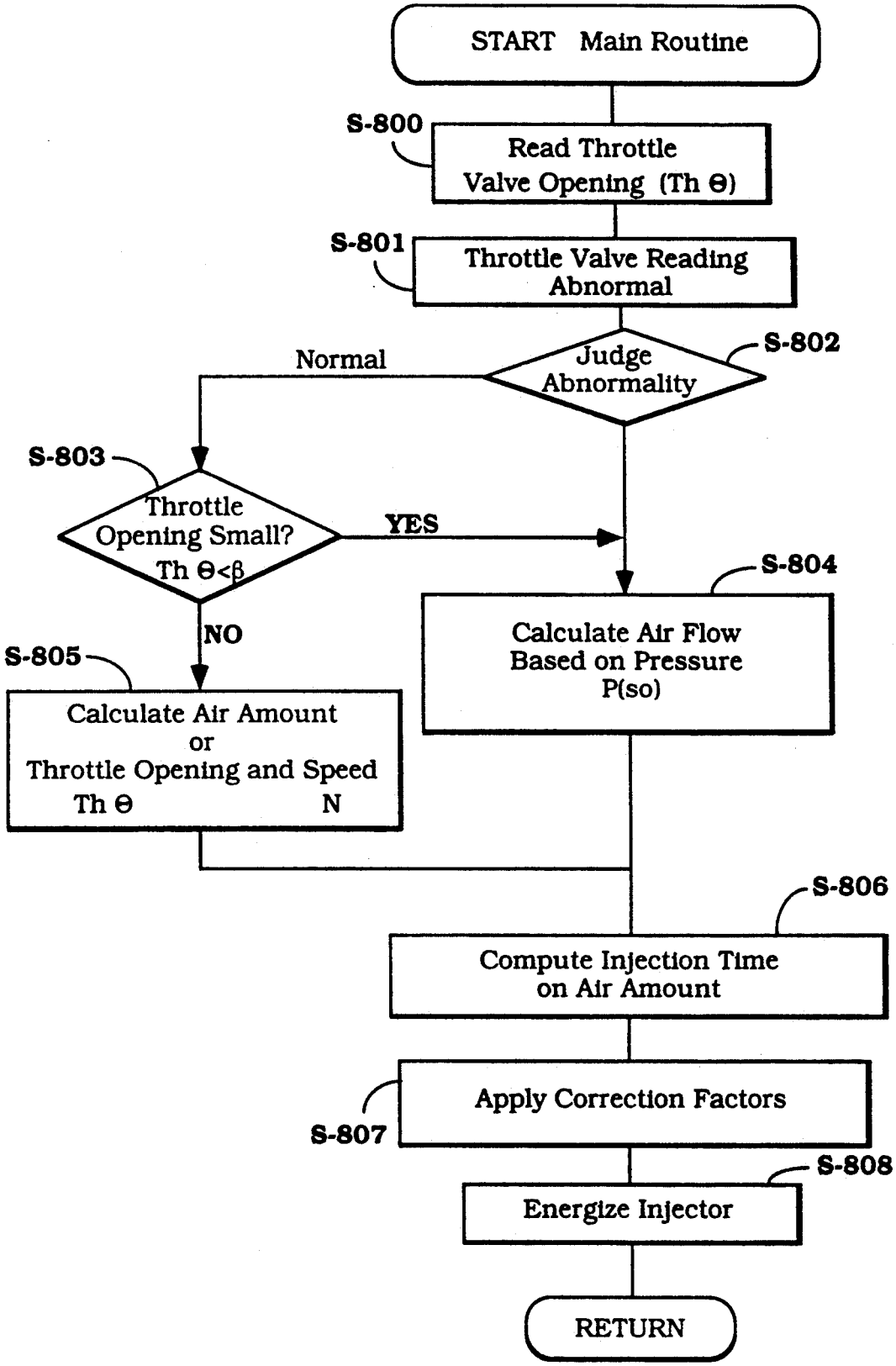
FIG. 8 is a graphical view of a control routine, in part similar to FIG. 3, but operating in accordance with a different control principle.

This control routine is shown in FIG. 8 and once the main control routine starts, the program moves to the step S-800 to read throttle valve opening via the throttle position detector 54. The program then moves to the step S-801 to determine if there is an abnormality in the reading of the throttle valve position. The program then moves to the step S-802 to determine if the numbers of abnormalities exceeds a small percentage, in a manner similar to the routine at S-617 of FIG. 6.

If, at the step S-802 it is determined that the throttle valve reading is normal, the program moves to the step S-803 to determine if the throttle valve position is relatively small. That is, if the throttle valve opening angle (ThΘ) is less than $\beta$, the program then determines that there is a low throttle valve opening and the program defaults to the pressure based basis for determining air flow at the step S-804. In a like manner, if the throttle valve reading has been judged to be abnormal because of excessive percent errors, the program also moves to the step S-804. From the step S-804, the program then moves to the control routine of FIG. 4 and as previously described.

If, however, at the step S-803 it is determined that the throttle valve opening is not small, then the program moves to the step S-805 so as to calculate the intake air amount in the manner as set forth in FIG. 6.

Figure 4:
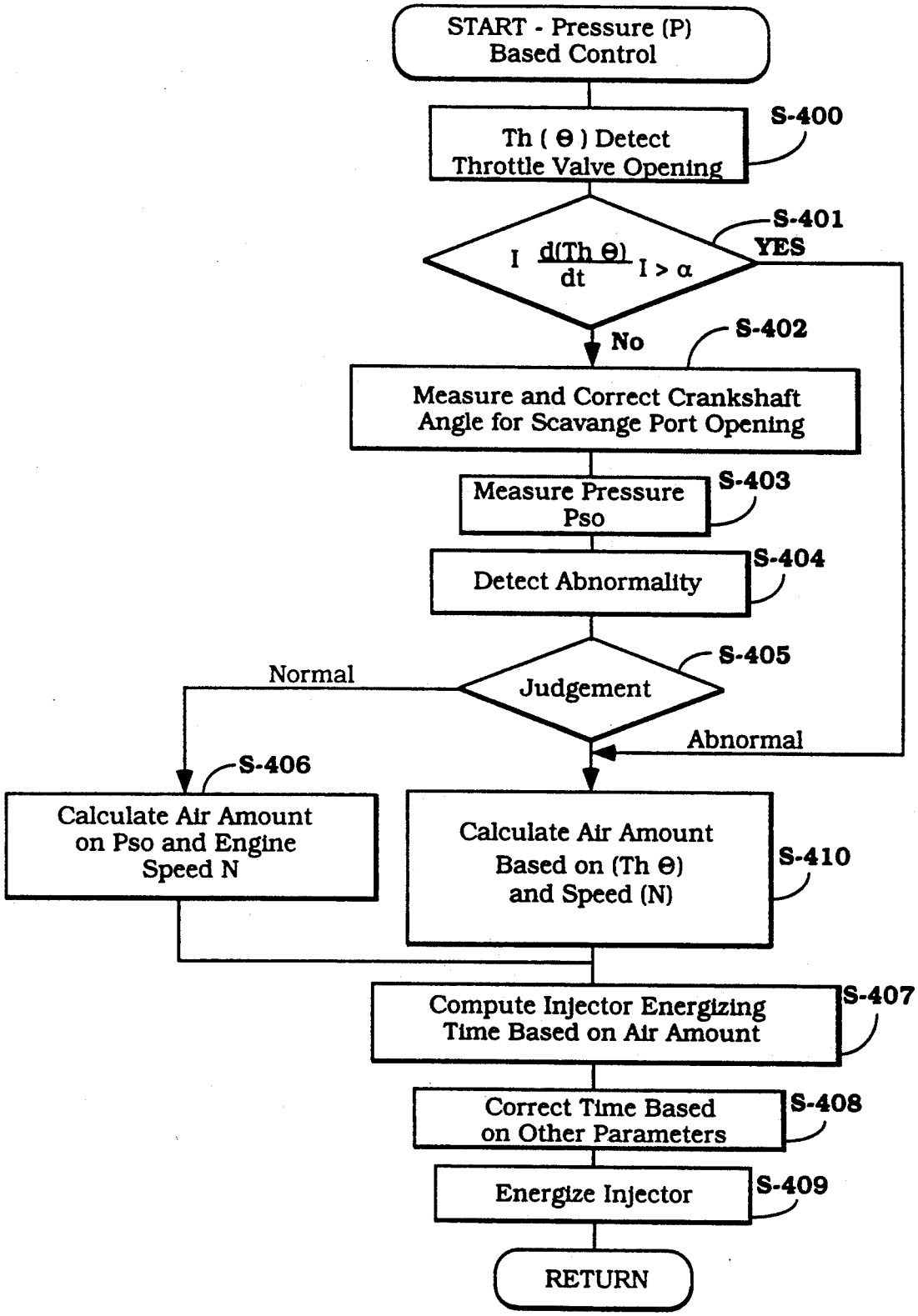
FIG. 4 is a block diagram of a subroutine for generating the fuel injection control in response to sensed pressures in the crankcase.

Once the air amounts have been calculated at the steps S-804 or S-805 depending upon the routines of FIGS. 4 or 6, respectively, the program moves to the step S-806 so as to calculate the injection time based upon the air flow amount to provide the desired fuel/air ratio. The program then moves to the step S-807 to read other corrective figures in air flow amounts and make a corresponding adjustment in the fuel injection timing. The program then moves to the step S-808 to energize the injector to supply fuel for the desired timing and duration. The program then returns.

It should be readily apparent from the foregoing description that the described embodiments provide extremely effective fuel injection control and optimum under all conditions while at the same time minimizing cycle to cycle variations by using average readings and also by determining error not based upon only an erroneous signal but rather a percentage of error signals. Of course, the foregoing description is that of preferred embodiments of the invention and various changes and modifications may be made without departing from the spirit and scope of the invention, as defined by the appended claims.

We claim:

1. A fuel injection control system for an internal combustion engine having a fuel injector for injecting fuel for engine operation, first sensor means for sensing a first engine running condition, second sensor means for sensing a second engine running condition different from said first running condition, and control means for receiving signals from said first sensor means and said second sensor means and controlling the fuel injected by said fuel injector, said control means including determining means for determining which of the signals from said first sensor means and said second sensor means will determine the primary control of the fuel injected by said fuel injector and controlling the fuel injected by said fuel injector from the output only of the selected sensor means.

2. A fuel injection control system as set forth in claim 1 wherein the determining means determines the primary control from the running conditions sensed by the first sensor means and the second sensor means.

3. A fuel injection control system as set forth in claim 2 wherein the determining means determines if a failure condition of one of the sensor means has occurred and then controls the fuel injection from the other sensor means.

4. A fuel injection control system as set forth in claim 3 wherein the failure condition is determined if an abnormal signal is received from the sensor means.

5. A fuel injection control system as set forth in claim 4 wherein the failure is determined if a number of abnormal signals for a given number of signals exceeds a certain predetermined percentage.

6. A fuel injection control system as set forth in claim 2 wherein the determining means makes the selection based on the running conditions sensed by the respective sensor means.

7. A fuel injection control system as set forth in claim 6 wherein the first sensor means is more sensitive in a first phase of the running conditions sensed by said first sensor means and the second sensor means is more sensitive in a second phase of running conditions sensed by said second sensor means and the first sensor means is used as the control during the first running condition and the second sensor means is employed as the control during the second running condition.

8. A fuel injection control system as set forth in claim 7 wherein the control means further senses a failure of one of the sensor means and places the control under the operation of the non-failed sensor means if a sensor has failed.

9. A fuel injection control system as set forth in claim 8 wherein the failure condition is determined if an abnormal signal is received from the failed sensor means.

10. A fuel injection control system as set forth in claim 9 wherein the failure is determined if a number of abnormal signals for a given number of signals exceeds a certain predetermined percentage.

11. A fuel injection control system as set forth in claim 1 wherein the first and second engine running conditions both provide a means for determining the same condition of fuel/air ratio of the engine.

12. A fuel injection control system as set forth in claim 11 wherein the fuel/air ratio is determined by the first and second sensor means from different running conditions of engine operation.

13. A fuel injection control system as set forth in claim 12 wherein the running condition comprises the mass air flow to the engine.

14. A fuel injection control system as set forth in claim 13 wherein one of the sensor means senses throttle valve position.

15. A fuel injection control system as set forth in claim 14 wherein the other of the sensor means senses pressure in the engine.

16. A fuel injection control system as set forth in claim 13 wherein the engine is a two cycle crankcase compression internal combustion engine and the other of the sensor means senses crankcase compression pressure.

17. A fuel injection control system as set forth in claim 13 wherein the determining means makes the selection based on the running conditions sensed.

18. A fuel injection control system as set forth in claim 17 wherein the one running condition is a steady state condition.

19. A fuel injection control system as set forth in claim 18 wherein the engine is a two cycle crankcase compression internal combustion engine and one sensor means senses crankcase compression pressure.

20. A fuel injection control system as set forth in claim 19 wherein the other running condition comprises acceleration.

21. A fuel injection control system as set forth in claim 20 wherein the second sensor means measures throttle valve condition.

22. A fuel injection control system as set forth in claim 17 wherein the one running condition comprises acceleration.

23. A fuel injection control system as set forth in claim 22 wherein one sensor means senses throttle valve position.

24. A fuel injection control system as set forth in claim 17 wherein the control means further senses a failure of one of the sensor means and places the control under the operation of the non-failed sensor means.

25. A fuel injection control system as set forth in claim 24 wherein the control means selects a further control mode in the event of failure of both of the sensor means.

26. A fuel injection control system as set forth in claim 1 wherein the control bases the amount of fuel injection upon the sensed condition during a plurality of cycles.

27. A fuel injection control system as set forth in claim 26 wherein the plurality of cycles comprises a fixed number of cycles and wherein on the sensing of a new condition on a succeeding cycle the oldest previously sensed condition is replaced by the new condition.

28. A fuel injection control system as set forth in claim 27 wherein the condition comprises a failure condition.

29. A fuel injection control method as set forth in claim 28 wherein the failure condition is determined if an abnormal signal is received from the sensor means.

30. A fuel injection control method as set forth in claim 29 wherein the failure is determined if a number of abnormal signals for a given number of signals exceeds a certain predetermined percentage.

31. A fuel injection control method for an internal combustion engine having a fuel injector for injecting fuel for engine operation, first sensor means for sensing a first engine running condition, second sensor means for sensing a second engine running condition different from said first running condition, said method comprising the steps of receiving signals from said first sensor means and said second sensor means and controlling the fuel injected by said fuel injector, selecting which of the signals from said first sensor means and said second sensor means will determine the primary control of the fuel injected by said fuel injector and controlling the fuel injected by said fuel injector from the output only of the selected sensor means.

32. A fuel injection control method as set forth in claim 31 wherein the selection is made upon the conditions sensed by the first sensor means and the second sensor means.

33. A fuel injection control method as set forth in claim 32 wherein the condition comprises a failure condition.

34. A fuel injection control method as set forth in claim 33 wherein the failure condition is determined if an abnormal signal is received from the respective sensor means.

35. A fuel injection control method as set forth in claim 34 wherein the failure is determined if a number of abnormal signals for a given number of signals exceeds a certain predetermined percentage.

36. A fuel injection control method as set forth in claim 31 wherein the selection is based on the running conditions sensed.

37. A fuel injection control method as set forth in claim 36 wherein the first sensor means is more sensitive in a first phase of running conditions sensed by the first sensor means and the second sensor means is more sensitive in a second phase of running conditions sensed by the second sensor means and the first sensor means is used as the primary control during the first running condition and the second sensor means is employed as the control during the second running condition.

38. A fuel injection control method as set forth in claim 37 wherein if a failure of one of the sensor means occurs the primary control is placed under the operation of the non-failed sensor means.

39. A fuel injection control method as set forth in claim 38 wherein the failure condition is sensed by sensing an abnormal signal from the failed sensor means.

40. A fuel injection control method as set forth in claim 39 wherein the failure is determined if a number of abnormal signals for a given number of signals exceeds a certain predetermined percentage.

41. A fuel injection control method as set forth in claim 31 wherein the first and second engine running conditions both provide a means for determining the same condition of fuel/air ratio for the engine.

42. A fuel injection control method as set forth in claim 41 wherein the fuel/air ratio is determined by the first and second sensor means by determining different conditions of engine operation.

43. A fuel injection control method as set forth in claim 42 wherein the condition comprises the mass air flow to the engine.

44. A fuel injection control method as set forth in claim 43 wherein one of the sensor means senses throttle valve position.

45. A fuel injection control method as set forth in claim 44 wherein the other of the sensor means senses pressure in the engine.

46. A fuel injection control method as set forth in claim 43 wherein the engine is a two cycle crankcase compression internal combustion engine and one sensor means senses crankcase compression pressure.

47. A fuel injection control method as set forth in claim 43 wherein the selection is based on the running conditions sensed.

48. A fuel injection control method as set forth in claim 47 wherein the one running condition is a steady state condition.

49. A fuel injection control method as set forth in claim 48 wherein the engine is a two cycle crankcase compression internal combustion engine and one sensor means senses crankcase compression pressure.

50. A fuel injection control method as set forth in claim 49 wherein the other running condition comprises acceleration.

51. A fuel injection control method as set forth in claim 50 wherein the second sensor means measures throttle valve condition.

52. A fuel injection control method as set forth in claim 47 wherein the one running condition comprises acceleration.

53. A fuel injection control method as set forth in claim 52 wherein one sensor means senses throttle valve position.

54. A fuel injection control method as set forth in claim 47 wherein upon a failure of one of the sensor means the primary control is placed under the operation of the non-failed sensor means.

55. A fuel injection control method as set forth in claim 54 wherein a further control mode is selected in the event of failure of both of the sensor means.

56. A fuel injection control method as set forth in claim 31 wherein the amount of fuel injection is selected upon the sensed condition during a plurality of cycles.

57. A fuel injection control method as set forth in claim 56 wherein the plurality of cycles comprises a fixed number of cycles and wherein on the sensing of a new condition on a succeeding cycle the oldest previously sensed condition is replaced by the new condition.

58. A fuel injection control method as set forth in claim 57 wherein the condition comprises a failure condition.

59. A fuel injection control method as set forth in claim 58 wherein the failure condition is sensed by sensing an abnormal signal from the sensor means.

60. A fuel injection control method as set forth in claim 59 wherein the failure is determined if a number of abnormal signals for a given number of signals exceeds a certain predetermined percentage.

61. A fault detecting system for an internal combustion engine fuel injection control system, said control system comprising means for detecting an engine running condition and outputting a signal indicative of said condition for processing by said fuel injection control system, said fault detecting system comprises means for comparing said signal with signals normally expected for the engine running condition and generating an error signal when the signal falls outside of said normal signals, means for repeating said comparison a predetermined number of times, and means for indicating a fault condition if the number of errors in a given number of tests exceeds a set percentage of the number of tests.

62. A fault detecting system as set forth in claim 61 wherein the set percentage is less than 100%.

63. A fault detecting system as set forth in claim 62 wherein the set percentage is less than 5%.

64. A fault detecting system as set forth in claim 61 further including means for shifting the control of the fuel injection from the detected engine running condition to another detected engine running condition in the event of failure.

65. A fault detecting system as set forth in claim 64 wherein the other engine running condition is detected by a second sensor.

66. A fault detecting system as set forth in claim 65 further including means for detecting an abnormal condition in the second sensor and defaulting to a safety control mode in the event of failure of both of the sensors.

67. A fault detecting method for an internal combustion engine fuel injection control system, said control system comprising means for detecting an engine running condition and outputting a signal indicative of said condition for processing by said fuel injection control system, said fault detecting method comprises comparing said signal with signals normally expected for the engine running condition and generating an error signal when the signal falls outside of said normal signals, repeating said comparison a predetermined number of times, and indicating a fault condition if the number of errors in a given number of tests exceeds a set percentage.

68. A fault detecting method as set forth in claim 67 wherein the set percentage is less than 100%.

69. A fault detecting method as set forth in claim 68 wherein the set percentage is less than 5%.

70. A fault detecting method as set forth in claim 67 further including shifting the control of the fuel injection from the detected engine running condition to another detected engine running condition in the event of failure.

71. A fault detecting method as set forth in claim 70 wherein the other engine running condition is detected by a second sensor.

72. A fault detecting method as set forth in claim 71 further including detecting an abnormal condition in the second sensor and defaulting to a safety control mode in the event of failure of both of the sensors.

73. A fuel injection control system comprising means for sensing an engine running condition and providing an output signal indicative of said condition, means for accumulating a set number of signals from a selected number of successive measurements, and means for initiating a control signal for controlling said fuel injection system for a successive period based upon the accumulated values.

74. A fuel injection control system as set forth in claim 73 wherein a new value is measured on the next cycle and that new value substituted for the oldest previously memorized value for determining the accumulated value for the next operation cycle.

75. A fuel injection control method comprising sensing an engine running condition and providing an output signal indicative of said condition, accumulating a set number of signals from a selected number of successive measurements, and initiating control for said fuel injection system for a successive period based upon the accumulated values.

76. A fuel injection control method as set forth in claim 75 wherein a new value is measured on the next cycle and that new value substituted for the oldest previously memorized value for determining the accumulated value for the next operation cycle.

* * * * *

UNITED STATES PATENT AND TRADEMARK OFFICE

CERTIFICATE OF CORRECTION

PATENT NO. : 5,284,118

DATED : February 8, 1994

INVENTOR(S) : Masahiko Kato, et al

It is certified that error appears in the above-indentified patent and that said Letters Patent is hereby corrected as shown below:

Column 13, line 40, Claim 11 delete "of" and insert --for--.

Column 14, line 33, Claim 29 delete "method" and insert --control system--.

Column 14, line 36, Claim 30 delete "method" and insert --control system--.

Signed and Sealed this

Twenty-seventh Day of September, 1994

*Attest:*

*Attesting Officer*

Bruce Lehman

BRUCE LEHMAN

*Commissioner of Patents and Trademarks*